United States Patent [19]

Wilson et al.

[11] Patent Number: 4,997,497

[45] Date of Patent: Mar. 5, 1991

[54] CASTABLE SMOKE-PRODUCING PYROTECHNIC COMPOSITIONS

[75] Inventors: Edgar R. Wilson, Simi Valley; Milton B. Frankel, Tarzana; Joseph E. Flanagan, Woodland Hills; Louis R. Grant, Los Angeles, all of Calif.

[73] Assignee: Rockwell International Corporation, El Segundo, Calif.

[21] Appl. No.: 504,811

[22] Filed: Apr. 5, 1990

[51] Int. Cl.[5] ..... C06C 45/10

[52] U.S. Cl. ..... 149/19.6; 149/19.4; 149/19.92; 149/88; 149/109.6

[58] Field of Search ..... 149/19.6, 109.6, 88, 149/19.4, 19.92

[56] References Cited

U.S. PATENT DOCUMENTS

| | | | |
|---|---|---|---|
| 4,268,450 | 5/1981 | Frankel et al. | 102/334 |
| 4,269,637 | 5/1981 | Flanagan | 149/19.6 |
| 4,379,903 | 4/1983 | Reed et al. | 149/19.6 |
| 4,555,178 | 6/1984 | Sedat | 149/19.6 |
| 4,781,861 | 11/1988 | Wilson et al. | 260/349 |
| 4,812,180 | 3/1989 | Sayles | 149/19.5 |
| 4,841,865 | 6/1989 | Liberman | 102/334 |

*Primary Examiner*—Stephen J. Lechert, Jr.

*Attorney, Agent, or Firm*—H. Fredrick Hamann; Harry B. Field; David C. Faulkner

[57] ABSTRACT

A castable smoke-producing pyrotechnic composition comprising a hydroxy-terminated azido polymer binder with a polyisocyanate curative, an energetic plasticizer, and a dye in an amount sufficient to generate colored smoke.

27 Claims, No Drawings

CASTABLE SMOKE-PRODUCING PYROTECHNIC COMPOSITIONS

BACKGROUND OF THE INVENTION

1. Field of the Invention

This invention is for pyrotechnic compositions for colored smoke production.

2. Description of Related Art

Pyrotechnic compositions for colored smoke production utilize the atomization of a dye by the use of a high energy pyrotechnic explosive, or by volatilization of a dye by the heat produced during the burning of a pyrotechnic composition. A conventional pyrotechnic composition for colored smoke production includes a dye mixed with a heat producing composition. The heat-producing composition is typically a fuel-oxidizer combination such as sulfur-potassium chlorate or sucrose-potassium chlorate. The fuel-oxidizer combination normally contains a small amount of coolant, such as sodium bicarbonate.

Other pyrotechnic compositions for producing colored smoke have been made by incorporating an iodine-base oxidizer with a suitable fuel, so that upon combustion or detonation of the composition, either iodine or colored metallic iodides, or both, are formed and dispersed by the heat of the reaction.

These pyrotechnic compositions are generally dry mixed and pressed into a cannister to provide a coherent shape.

Instability and discontinuity of the final formulation have been avoided by utilizing inert polymeric binders to yield a castable system. Polymer-bonded smoke compositions offer numerous advantages, such as improved mechanical properties and safety in handling, over conventional pressed smoke mixtures. However, the amount of liquid binder required is excessive when large amounts of finely-divided pigment are required. Accordingly, to achieve a castable composition, the organic pigment-pyrotechnic mixture is usually so diluted with inert binder that the smoke generating capability of the charge is unacceptably reduced.

DESCRIPTION AND OBJECTS OF THE INVENTION

An object of the present invention is realized in a pyrotechnic composition for colored smoke production based on the formulation of a colored dye with an energetic azido binder system. On combustion of this binder system, the colored dye is vaporized, without decomposition, as a colored smoke.

A further object of the present invention is the provision of a castable pyrotechnic composition for colored smoke production.

Another object of the present invention resides in a pyrotechnic composition utilizing energetic plasticizers with the azido polymer, thereby providing an elastomeric product with improved safety and storage qualities.

Yet another object of the present invention is a castable pyrotechnic composition enjoying great versatility in the size and shape of the cast product.

Further objects and advantages of the present invention will become apparent upon reading the specification and claims.

DETAILED DESCRIPTION OF THE PREFERRED EMBODIMENTS

The castable colored smoke-producing compositions of the present invention are based on, in combination, a hydroxy-terminated azido polymer binder, an energetic plasticizer, and a suitable dye. A conventional polyisocyanate curative, such as hexamethylene diisocyanate (HMDI), is used for the in situ curing of the polymer, together with a cure catalyst, such as dibutyl tin dilaurate (DBTDL). One primary function of the azido binder is to provide a high source of nitrogen at a low flame temperature, which will effectively disperse the colored smokes at a desired burn rate during combustion. In accordance with the present invention, a preferred azido energetic binder is glycidyl azide polymer (GAP) disclosed and claimed in U.S. Pat. No. 4,268,450, incorporated herein by reference. The pyrotechnic composition, or cast-cure binder system, also incorporates an energetic azido plasticizer such as GAP-Azide or 1,5-diazido-3-nitrazapentane (DANPE) (see U.S. Pat. No. 4,781,861, incorporated herein by reference), nitrate, and nitro compounds such as trimethylolethane trinitrate (TMETN), and bis(dinitropropyl) acetal-formal (BDNPA-F), which are used in combination with the energetic azido binder in order to maintain processability of the castable pyrotechnic compositions.

A broad class of dyes can be used, depending upon the colored smoke required. The dyes include nitro, azo, triphenylmethane, xanthane, and the like. A preferred dye is the quinaldine-based Atlasol Smoke Yellow S, comprising a mixture of 2-(2-Quinolinyl)-1H-Indene-1,3-(2H)-Dione and 2-(6-Methyl-2-Quinolinyl)-1H-Indene-1,3-(2H)-Dione (a.k.a. C.I. Solvent Yellow 33). Other examples of acceptable colored dyes which may be used in the present invention include 1-methylanthraquinone (Red) and 1,4-di-p-toluidinoanthraquinone (Green).

The smoke-producing compositions will usually contain, by weight, 25 to 75% of the dye, and 25 to 75% heat-producing energetic binder/ plasticizer composition. The ratio of plasticizer-to-polymer can be varied from 1:1 to 4:1, by weight.

The pyrotechnic compositions of the present invention can be ignited by any conventional technique, such as by the use of an electric squib or a pyrotechnic fuse. Percentages are based on weight herein unless specified to the contrary.

The following non-limitive examples illustrate the invention:

EXAMPLE 1

In a suitable container equipped with a mixer was placed 20.25g (0.017 meq) of glycidyl azide polymer (GAP) triol and 43.3g of glycidyl azide polymer azide (GAPA). To this solution was added, portionwise, with good mixing, a total of 65g of Atlasol Smoke Yellow S, followed by the addition of 1.45g (0.017 meq) of hexamethylene diisocyanate (HMDI) and 70 microliters of dibutyl tin dilaurate (DBTDL). After 15 minutes of mixing under vacuum, the homogeneous mixture was cast into tube molds and cured overnight at 160° F. The composition was ignited with an electrically heated resistant wire, and burned smoothly with a burn rate of 0.018 in/sec. evolving copious quantities of brilliant yellow smoke.

EXAMPLE 2

In this example, the procedure for preparation is identical to that of EXAMPLE 1, except that the plasticizer-to-polymer binder ratio in the binder system is increased from 2:1 to 4:1. The overall composition is summarized below:

| Ingredients | Wt. Percent |
|---|---|
| Atlasol Smoke Yellow S | 65.00 g |
| GAP Triol | 12.13 g |
| GAPA | 52.00 g |
| HMDI | .87 g |
| DBTDL | 70 μl |

The burn rate of the composition of EXAMPLE 2 was 0.023 in/sec. yielding brilliant yellow smoke.

Obviously, many modifications and variations of the present invention are possible in light of the above teachings. It is therefore to be understood that, within the scope of the appended claims, the invention may be practiced otherwise than as specifically described.

We claim:

1. A castable smoke-producing pyrotechnic composition consisting essentially of a glycidyl azide polymer binder and curative, an energetic plasticizer, and a dye.

2. The castable pyrotechnic composition of claim 1 wherein the energetic plasticizer is selected from the group consisting of azides, nitrates, and nitro compounds.

3. The castable pyrotechnic composition of claim 1 wherein the energetic plasticizer is glycidyl azide polymer azide (GAPA).

4. The castable pyrotechnic composition of claim 1 wherein the energetic plasticizer is 1,5-diazido-3-nitrazapentane (DANPE).

5. The castable pYrotechnic composition of claim 1 wherein the energetic plasticizer is trimethylolethane trinitrate.

6. The castable pyrotechnic composition of claim 1 wherein the energetic plasticizer is bis(dinitropropyl) acetal-formal.

7. The castable pyrotechnic composition of claim 1 wherein the plasticizer to binder ratio is from 1:1 to 4:1, by weight.

8. The castable pyrotechnic composition of claim 1 wherein the dye is a quinaldine-based dye.

9. The castable pyrotechnic composition of claim 1 wherein the dye is 1-methylanthraquinone.

10. The castable pyrotechnic composition of claim 1 wherein the dye is 1,4-di-p-toluidinoanthraquinone.

11. The castable pyrotechnic composition of claim 1 characterized by a dye content of from 25 percent (25%) to 75 percent (75%).

12. The castable pyrotechnic composition of claim 1 characterized by an energetic binder/plasticizer content of from 25 percent (25%) to 75 percent (75%).

13. A method of preparing a castable smoke-producing pyrotechnic composition comprising:

(a) combining, in a suitable container, a glycidyl azide polymer binder with a polyisocyanate curative, an energetic plasticizer, and a dye;

(b) mixing the combined ingredients into a homogeneous mixture;

(c) casting the homogeneous mixture into molds,; and (d) curing the cast homogeneous mixture.

14. The method of claim 13 wherein the mixing is carried out under vacuum.

15. The method of claim 13 wherein the homogeneous mixture is cured overnight at 160° F.

16. The method of claim 13 wherein the energetic plasticizer is selected from the group consisting of azides, nitrates, and nitro compounds.

17. The method of claim 13 wherein the energetic plasticizer is glycidyl azide polymer azide (GAPA).

18. The method of claim 13 wherein the energetic plasticizer is 1,5-diazido-3-nitrazapentane (DANPE).

19. The method of claim 13 wherein the energetic plasticizer is trimethylolethane trinitrate.

20. The method of claim 13 wherein the energetic plasticizer is bis(dinitropropyl) acetal-formal.

21. The method of claim 13 wherein the plasticizer to binder ratio is from 1:1 to 4:1, by weight.

22. The method of claim 13 wherein the dye is a quinaldine-based dye.

23. The method of claim 13 wherein the dye is 1-methylanthraquinone.

24. The method of claim 13 wherein the dye is 1,4-di-p-toluidinoanthraquinone.

25. The method of claim 13 wherein the homogeneous mixture is characterized by a dye content of from 25 percent (25%}to 75 percent (75%).

26. The method of claim 13 wherein the homogeneous mixture is characterized by a plasticizer to binder ratio of from 1:1 to 4:1, by weight.

27. The method of claim 13 wherein the homogeneous mixture is characterized by an energetic binder/-plasticizer content of from 25 percent (25%) to 75 percent (75%).

* * * * *